United States Patent [19]

Watanabe et al.

[11] Patent Number: 4,787,140

[45] Date of Patent: Nov. 29, 1988

[54] APPARATUS FOR ATTACHING TOP END STOPS TO A CONTINUOUS SLIDE FASTENER CHAIN

[75] Inventors: Kozo Watanabe, Kurobe; Yasuhiko Matsuda, Toyama; Shunji Akashi, Kurobe, all of Japan

[73] Assignee: Yoshida Kogyo, K. K., Tokyo, Japan

[21] Appl. No.: 897,815

[22] Filed: Aug. 19, 1986

[30] Foreign Application Priority Data

Aug. 28, 1985 [JP] Japan ..... 60-131041[U]
Aug. 28, 1985 [JP] Japan ..... 60-131042[U]
Aug. 31, 1985 [JP] Japan ..... 60-133821[U]

[51] Int. Cl.[4] ..... A41H 37/06

[52] U.S. Cl. ..... 29/767; 29/408; 29/509

[58] Field of Search ..... 29/767, 766, 33.2, 408, 29/770, 509, 515, 243.56

[56] References Cited

U.S. PATENT DOCUMENTS 3,133,288 5/1964 Ohgren ..... 29/243.56
3,588,991 6/1971 Maisenbacher ..... 29/408
4,203,207 5/1980 Oyama ..... 29/767
4,217,685 8/1980 Seki ..... 29/767
4,307,511 12/1981 Yoshida ..... 29/767
4,332,071 6/1982 Takahashi ..... 29/408

FOREIGN PATENT DOCUMENTS 50-60356 5/1975 Japan .

*Primary Examiner*—P. W. Echols

[57] ABSTRACT

A clamping mechanism mounted on a punch/die holder includes a pair of punch arms angularly movably supported on the punch/die holder and a die fixed to the punch/die holder and disposed between the punch arms for supporting U-shaped top end stops between the die and lower ends of the punch arms. The punch arms are angularly moved to cause the lower ends thereof to clinch the top end stops respectively about the beaded marginal edges of slide fastener stringer tapes at one of element-free spaces adjacent to ends of two rows of coupling elements. The die and the lower ends of the punch arms have slanted surfaces for smoothly guiding the beaded marginal edges into the top end stops between the die and the punch arms. The beaded marginal edges of the stringer tapes at the element-free space are separately directed toward the top end stops supported between the die and the lower ends of the punch arms.

7 Claims, 8 Drawing Sheets

APPARATUS FOR ATTACHING TOP END STOPS TO A CONTINUOUS SLIDE FASTENER CHAIN

BACKGROUND OF THE INVENTION

1. Field of the Invention

The present invention relates to an apparatus for attaching top end stops to a continuous slide fastener chain.

2. Description of the Prior Art

One known apparatus for attaching two top ends stops simultaneously to a continuous slide fastener chain is disclosed in Japanese Laid-Open Patent Publication No. 50-60356 published May 24, 1975. The disclosed apparatus includes a punch mechanism having a pair of punch levers with cam surfaces defined on outer lower sides thereof. When the punch levers are lowered, the cam surfaces are engaged by respective rollers to push the punch levers toward each other for thereby clamping top end stops on longitudinal marginal edges of slide fastener stringer tapes in cooperation with a die block disposed between the punch levers. Since the punch levers are forcibly displaced by the rollers, the punch levers are subject to undue stresses and frictional resistance, often failing to clamp the top end stops accurately on the stringer tapes Therefore, some top end stops thus attached may be slightly out of proper posture, and the resultant slide fasteners are of poor product quality. Another problem is that considerable drive forces must be imposed on the punch mechanism in order to attach two top end stops simultaneously in coaction with the rollers. Repeated application of substantial drive forces tends to lower the durability of the punch mechanism in a short period of time.

The two top end stops are gripped between the confronting flat surfaces of the die block and the punch levers at their lower ends, with the lower ends of the top end stops being exposed downwardly As a consequence, upon descent of the punch mechanism toward the longitudinal marginal edges of the stringer tapes, the marginal tape edges are apt to be caught by the exposed ends of the top end stops carried by the punch mechanism, and hence may be not introduced smoothly into the respective top end stops. The lower ends of the die block and punch levers which hold the top end stops together have flat surfaces incapable of guiding the marginal tape edges reliably into the top end stops.

U.S. Pat. No. 4,203,207 issued on May 20, 1980 also discloses a top end stop applicator including a pair of grippers for gripping longitudinal marginal edges of a pair of slide fastener stringer tapes, the grippers being angularly movable apart from each other for successive disengagement of rows of coupling elements Another conventional top end stop applicator shown in U.S. Pat. No. 4,217,685 issued on Aug. 19, 1980 includes a separator having a pair of pointed members. The pointed members are inserted in an element-free space in a slide fastener chain and are laterally moved apart from each other to split two intermeshing rows of coupling elements into individual rows. These mechanisms for separating coupling elements are however disadvantageous in that the mechanisms are complex in structure, and the rows of coupling elements are liable to be separated for irregular lengths since they are separated by the grippers or separators which are laterally shifted from each other. With the coupling element rows separated for uneven lengths, top end stops may not be attached to the marginal tape edges at accurate positions. Inasmuch as the coupling element rows are split in the horizontal plane in which the slide fastener chain lies, the marginal tape edges may be displaced out of exact alignment with top end stops to be attached, and hence the top end stops may not be applied accurately and reliably to the marginal tape edges.

SUMMARY OF THE INVENTION

It is an object of the present invention to provide an apparatus for attaching top end stops to a continuous slide fastener chain, the apparatus including a clamping mechanism capable of being operated under a relatively small force for simultaneously clamping two top end stops firmly and accurately to longitudinal marginal edges of a pair of slide fastener stringer tapes, respectively.

Another object of the present invention is to provide an apparatus for attaching top end stops to a slide fastener chain, the apparatus including a clamping mechanism which can guide longitudinal marginal edges of a pair of slide fastener stringer tapes smoothly and reliably into respective top end stops to be applied thereto.

Still another object of the present invention is to provide an apparatus for attaching top end stops to a slide fastener chain, the apparatus including a separator capable of splitting two rows of coupling elements for a constant length and of directing longitudinal marginal edges of a pair of slide fastener stringer tapes upwardly for easy, accurate, and reliable attachment of top end stops to the marginal tape edges.

According to the present invention, there is provided an apparatus for attaching a pair of top end stops of a substantially U-shape to a continuous slide fastener chain composed of a pair of stringer tapes supporting a pair of intermeshing rows of coupling elements on and along respective beaded longitudinal marginal edges of the stringer tapes, the slide fastener chain having longitduinally spaced element-free spaces The apparatus comprises a punch/die holder, a clamping mechanism mounted on the punch/die holder and including a pair of punch arms angularly movably supported on the punch/die holder and a die fixed to the punch/die holder and disposed between the punch arms for supporting the top end stops between the die and first ends of the punch arms, and means operatively coupled between the punch/die holder and second opposite ends of the punch arms for angularly moving the punch arms to cause the first ends thereof to clinch the top end stops respectively about the beaded marginal edges of the stringer tapes at one of the element-free spaces adjacent to ends of the rows of coupling elements. The apparatus also includes directing means for separately directing the beaded marginal edges of the stringer tapes at the element-free space toward the top end stops supported between the die and the first ends of the punch arms. The directing means comprises a separator for progressively disengaging the intermeshing rows of coupling elements from the element-free space, and a tape holder for coacting with the separator to hold the stringer tapes and the disengaged coupling elements thereon adjacent to the element-free space for directing the beaded marginal edges thereat toward the top end stops.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
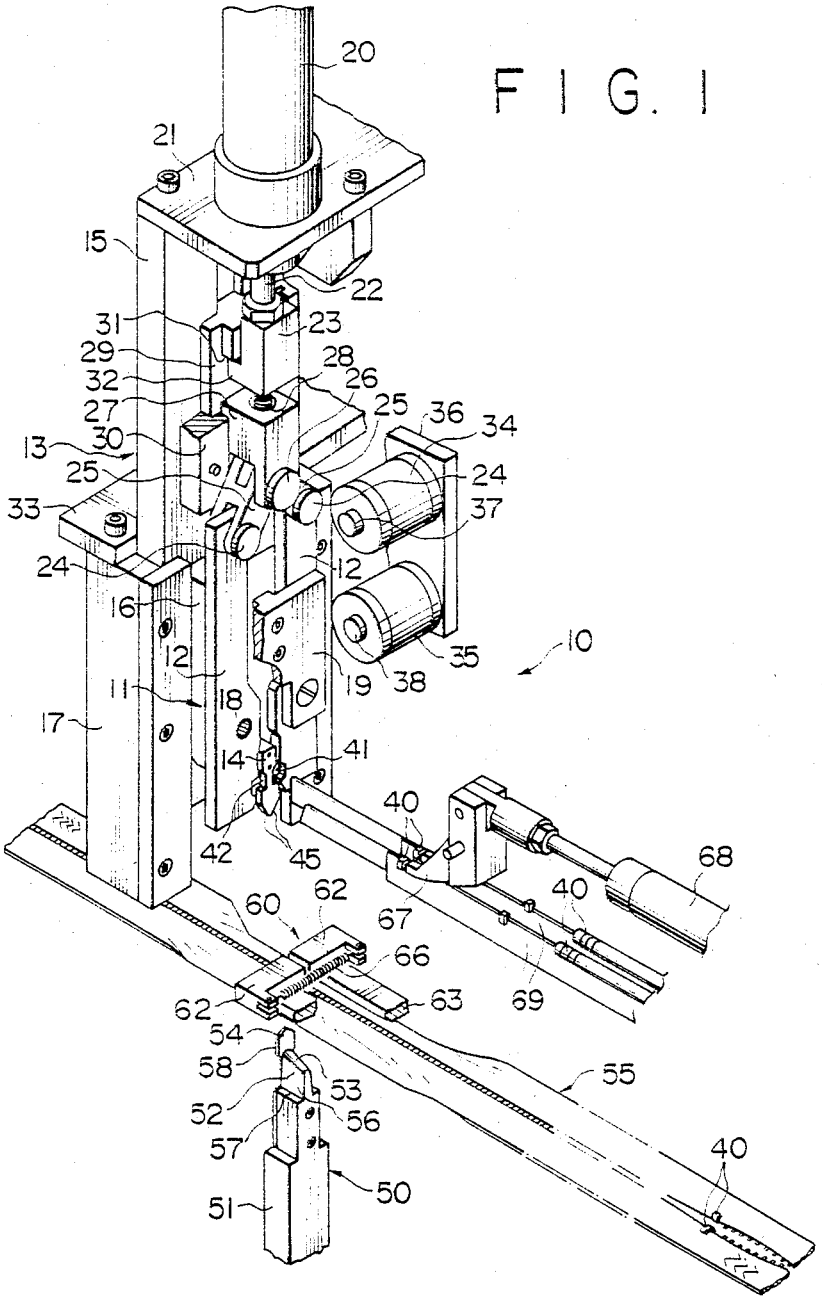
FIG. 1 is a perspective view of an apparatus for attaching top end stops to a continuous slide fastener chain according to the present invention.

The principles of the present invention are particularly useful when embodied in an apparatus, generally designated by the reference numeral 10, for attaching top end stops to a continuous slide fastener chain.

The apparatus 10 includes a clamping mechanism 11 which generally comprises a pair of vertical punch arms 12 angularly movably mounted on a vertical punch/die holder 13 and a die 14 fixedly mounted on the punch/-die holder 13 and positioned between the lower ends of the punch arms 12. The lower ends of the punch arms 12 and the laterally opposite sides of the die 14 cooperate with each other in clamping two top end stops on longitudinal marginal edges of a pair of slide fastener stringer tapes, as described later.

The punch/die holder 13 is composed of a first holder member 15 and a second holder member 16 attached to a lower side of the first holder member 15. The punch/-die holder 13 is vertically movable in a channel-shaped holder guide 17 by a suitable actuator (not shown) between an upper position to receive top end stops and a lower position to attach top end stops. The die 14 is securely fastened to the outer surface of the second holder member 16 remote from the first holder member 15 at a lower central position on the second holder member 16. The punch arms 12 are angularly movably supported by respective pivot pins 18 on the outer surface of the second holder member 16, the pivot pins 18 being positioned below the intermediate portions of the punch arms 12, i.e., more closely to the lower ends of the punch arms 12 than to the upper ends thereof. The punch arms 12 are retained for smooth angular movement by a punch arm cover 19 attached to the second holder member 16.

The upper ends of the punch arms 12 are operatively coupled by various interlinking members (described below) to a punch actuator 20 mounted on a support plate 21 fixed to the upper end of the first holder member 15. The punch actuator 20 may comprise any of a pneumatic cylinder, a hydraulic cylinder, an electric motor with a crank attached to its output shaft, and a solenoid. The punch actuator 20 has an actuator rod 22 coupled to an upper ram 23. The upper ends of the punch arms 12 are operatively connected by first pivot pins 24 to a pair of links 25, respectively, operatively coupled by a second pivot pin 26 to the lower end of a lower ram 27. A compression coil spring 28 is disposed under compression between the upper and lower rams 23, 27 for normally urging them apart. When the actuator 20 is operated, therefore, the punch arms 12 are angularly moved toward and away from each other about the pivot pins 18. The pivoted punch arms 12, the upper and lower rams 23, 27, the links 25, and the spring 28 thus jointly serve as a toggle mechanism for amplifying the force applied by the actuator 20 to the lower ends of the punch arms 12, so that top end stops can be applied to marginal tape edges with relatively small forces produced by the actuator 20.

The lower ram 27 is fixed to a ram holder 29 vertically slidably held by a ram holder guide 30 secured to the first holder member 15. The ram holder 29 has an overhanging step 31 engaging a lateral shoulder 32 of the upper ram 23. Therefore, the downward movement of the lower ram 27 under the resiliency of the spring 28 is limited to a certain extent by this engagement between the step 31 and the shoulder 32.

The channel-shaped holder guide 17 is fastened to a frame 33 of the apparatus 10. Two vertically spaced additional actuators 34, 35 such as pneumatic cylinders are supported on a vertical plate 36 attached to the frame 33, the actuators 34, 35 having piston rods 37, 38, respectively, positioned for engagement with a lateral surface of one of the punch arms 12.

Figure 4:
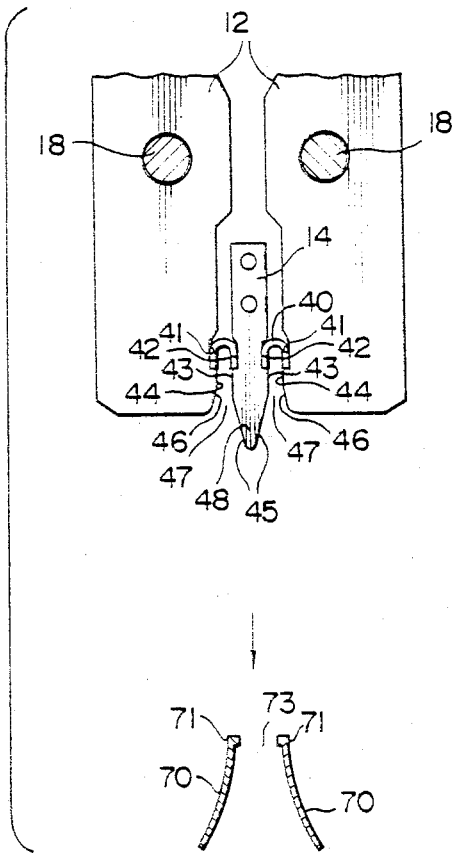
FIG. 4 is an enlarged fragmentary front elevational view of the lower ends of punch arms in the apparatus illustrated in FIG. 1.

As better shown in FIG. 4, the inner lower surfaces of the punch arms 12 are normally spaced laterally from the opposite outer surfaces of the die 14 for retaining substantially U-shaped top end stops 40 therebetween. The inner lower surfaces of the punch arms 12 have recesses 41, respectively, defined therein, whereas the opposite outer surfaces of the die 14 have recesses 42, respectively, defined therein and positioned in confronting relation to the recesses 41. Each of these recesses 41, 42 is shaped to neatly accommodate one of the legs of the top end stops 40. More specifically, the depth of each of the recesses 41, 42 is substantially equal to the thickness of the lower end of one of the legs of the top end stops 40. Therefore, when the top end stops 40 are retained between the punch arms 12 and the die 14, the legs, particularly their lower ends, of the top end stops 40 are snugly received in the recesses 41, 42, without projecting from the confronting inner and outer surfaces of the die 14 and the punch arms 12. The die 14 and the punch arms 12 also have straight lower side surfaces 43, 44, respectively, extending downwardly from the recesses 41, 42, and slanted lower end surfaces 45, 46, respectively, extending downwardly from the straight lower side surfaces 43, 44 and tapered away from each other to define a pair of downwardly flaring guide slots 47 between the die 14 and the punch arms 12. The guide slots 47 lead upwardly to cavities defined jointly by the recesses 41, 42 for receiving the top end stops 40 therein. The die 14 has a tapered lower end 48 projecting downwardly beyond the lower ends of the punch arms 18.

The lower inner surfaces of the punch arms 12 are normally urged toward each other under the resiliency of the spring 28, while being kept in slightly spaced relation to the lower outer surfaces of the die 14. Each of the punch arms 12 is resiliently spaced from the die 14 by a distance which is slightly smaller than the width of one of the top end stops 40 prior to its being clamped. Therefore, when the top end stops 40 are held in the recesses 41, 42 between the die 14 and the punch arms 12, the top end stops 40 are resiliently retained in place therebetween.

As shown in FIG. 1, the apparatus 10 also includes a separator 50 disposed below the clamping mechanism 11. The separator 50 has a separator body 51 including a splitter 52 with a wedge-shaped upper end 53 and a thin wedge-shaped inserter 54 attached to one side of the separator body 51. The upper end of the wedge-shaped inserter 54 is positioned above the wedge-shaped upper end 53. The separator 50 is vertically movable by a suitable actutator (not shown) toward and away from a slide fastener chain 55.

Figure 11:
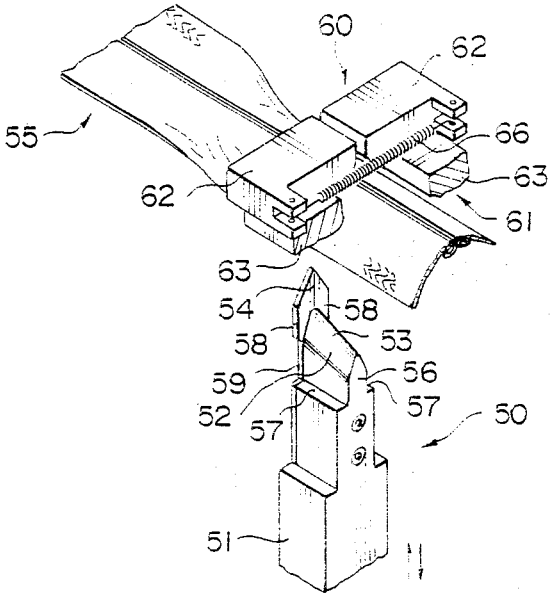
FIG. 11 is an enlarged fragmentary perspective view of a separator in the apparatus of FIG. 1.
Figure 13:
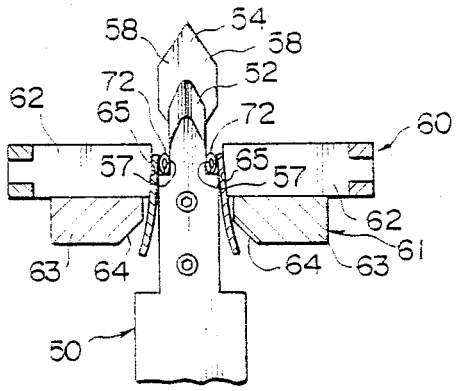
FIG. 13 is an enlarged fragmentary front elevational view of the separator shown in FIG. 12.

As better shown in FIGS. 11 and 13, the splitter 52 includes a base portion 56 beneath the wedge-shaped upper end 53. The wedge-shaped upper end 53 is tapered upwardly and is progressively lowered away from the wedge-shaped inserter 54. The separator body 51 also includes a pair of shoulders 57 facing upwardly and disposed one on each side of the base portion 56. The wedge-shaped inserter 54 has a pair of side edges 58 projecting laterally beyond the base portion 56 of the splitter 52, and a narrow portion 59 disposed below the side edges 58 and having the same width as that of the base portion 56, the narrow portion 59 being aligned with the base portion 56.

A tape holder 60 positioned above the separator 50 is slidably mounted on a chain guide 61 which serves to guide the slide fastener chain 55. The tape holder 60 comprises a pair of laterally spaced holder members 62 slidably disposed on respective guide members 63 of the chain guide 61. The chain guide members 63 have slanted inner opposite surfaces 64 for easy upward entry of the slide fastener chain 55 between the chain guide members 63. Likewise, the holder members 62 also have slanted inner opposite surfaces 65 for allowing the slide fastener chain 55 to be inserted easily between the holder members 62. The holder members 62 are normally biased toward each other by a tension spring 66 connected to the holder members 62.

As illustrated in FIG. 1, a plurality of top end stops 40 to be attached to the slide fastener chain 55 are supplied successively from a parts feeder (not shown) along chutes 69 terminating at ends positioned near the recesses 41, 42 of the clamping mechanism 11 as the punch/-die holder 13 is in the upper position to receive top end stops. Two top end stops 40 are fed at a time toward the chute ends by feed fingers 67 operated by an actuator 68 such as a pneumatic cylinder.

Figure 2:
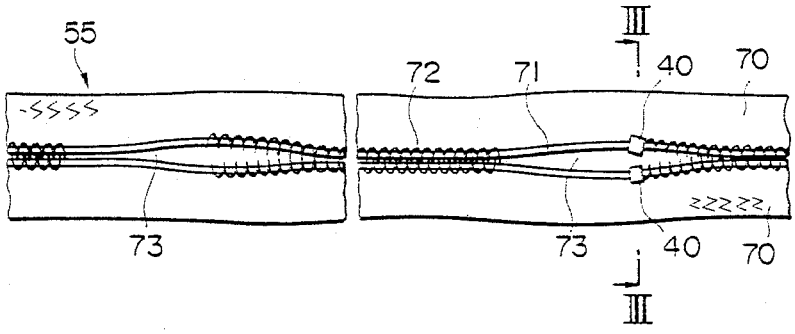
FIG. 2 is a fragmentary plan view of a continuous slide fastener chain to which top end stops are to be applied.
Figure 3:
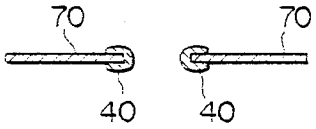
FIG. 3 is a cross-sectional view taken along line III—III of FIG. 2, showing attached top end stops.

As illustrated in FIG. 2, the side fastener chain 55 comprises a pair of slide fastener stringer tapes 70 each having a beaded longitudinal marginal edge 71 supporting thereon a row of coupling elements 72. The slide fastener chain 55 also has a plurality of longitudinally spaced element-free spaces or gaps 73 between the successive rows of coupling elements 72. As described below, the top end stops 40 are attached to the beaded marginal edges 71 in the element-free spaces 73 adjacent to ends of each row of coupling elements 72.

Operation of the apparatus 10 thus constructed is described below.

Figure 5:
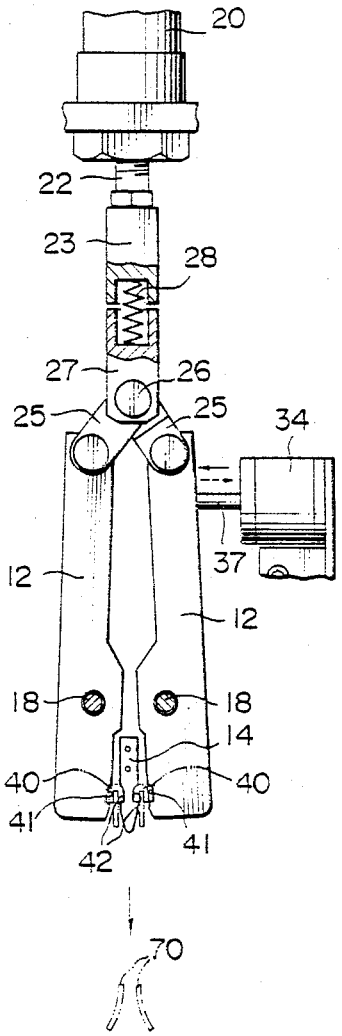
FIG. 5 is a front elevational view of a clamping mechanism including the punch arms shown in FIG. 4.

Two top end stops 40 are forcibly supplied by the feed fingers 67 down the chutes 69 into the cavities defined by the recesses 41, 42 between the die 14 and the punch arms 12, with the legs of the top end stops 40 being snugly fitted in the recesses 41, 42, as shown in FIGS. 4 and 5. The supplied top end stops 40 are resiliently retained between the die 14 and the punch arms 12 under the resiliency of the spring 28 disposed under compression between the upper and lower rams 23, 27. During the time when the top end stops 40 are being supplied, the actuator 34 (FIGS. 1 and 5) is operated to cause its piston rod 37 to push one of the punch arms 12 for thereby displacing the lower ends of the punch arms 12 slightly away from the die 14, so that the top end stops 40 can easily be inserted between the die 14 and the punch arms 12. This prevents the top end stops 40 from being damaged, deformed, or their paint from falling off. Then, the punch/die holder 13 is lowered to move the clamping mechanism 11 downwardly.

The slide fastener chain 55 is fed by a suitable chain feeder (not shown) and guided by the chain guide 61 to position one of the element-free spaces 73 (FIG. 2) at the tape holder 60. The separator 50 is moved upwardly toward the slide fastener chain 55 placed underneath the chain guide 61 as shown in FIG. 11. The separator 50 is continuously lifted to move the wedge-shaped inserter 54 into the element-free space 73 and then to force the wedge-shaped top end 53 of the splitter 52 to disengage some coupling elements 72 progressively from the element-free space 73. Since the wedge-shaped top end 53 is slanted downwardly away from the wedge-shaped inserter 54 and has a fixed length, it can smoothly disengage the coupling elements 72 for a constant length. The coupling elements 72 and the stringer tapes 70 are not subject to undue stresses and hence the coupling elements 72 remain firmly attached to the stringer tapes 70, because the coupling elements 72 are easily split from the element-free space 73.

Figure 12:
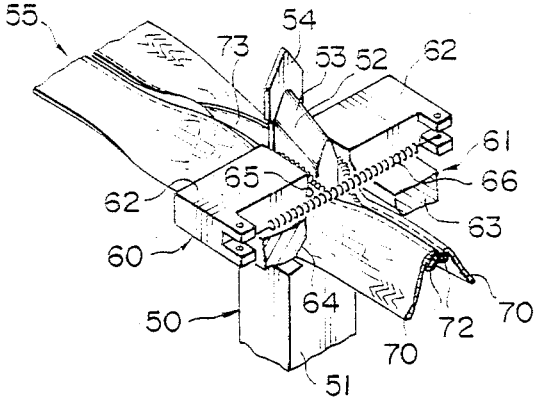
FIG. 12 is an enlarged fragmentary perspective view of the separator as it is inserted into a slide fastener chain, thereby splitting intermeshing rows of coupling elements.

At the same time, the disengaged coupling elements 72 (FIG. 13) are caught by the shoulders 57 of the separator body 51 and are pulled upwardly thereby between the tape holder members 62 as they are resiliently spread apart from each other against the resiliency of the spring 66. When the coupling elements 72 are pulled upwardly, the stringer tapes 70 are smoothly guided upwardly along the slanted surfaces 64 of the chain guide members 63 and the slanted surfaces 65 of the tape holder members 62. The beaded marginal edges 71 of the stringer tapes 70 are now directed upwardly while being held in place by and between the tape holder members 62, as shown in FIGS. 12 and 13. At this time, ends of the beaded marginal edges 71 in the element-free space 73 adjacent to the disengaged coupling elements 72 are positioned just behind the wedge-shaped inserter 54.

Figure 6:
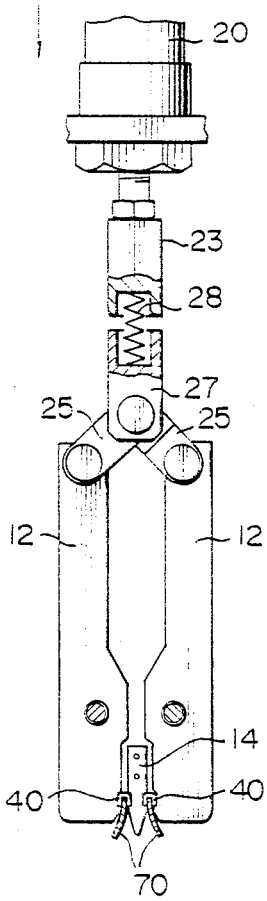
FIGS. 6 through 10 are front elevational views showing the manner in which top end stops are attached to longitudinal marginal edges of a pair of slide fastener stringer tapes by the clamping mechanism.
Figure 7:
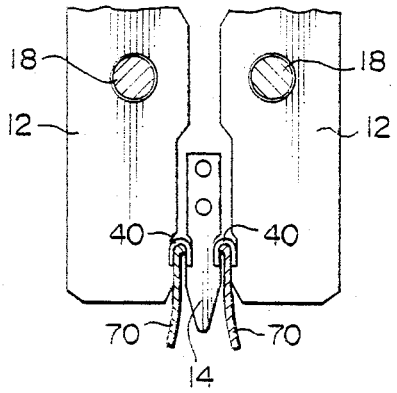
Figure 14:
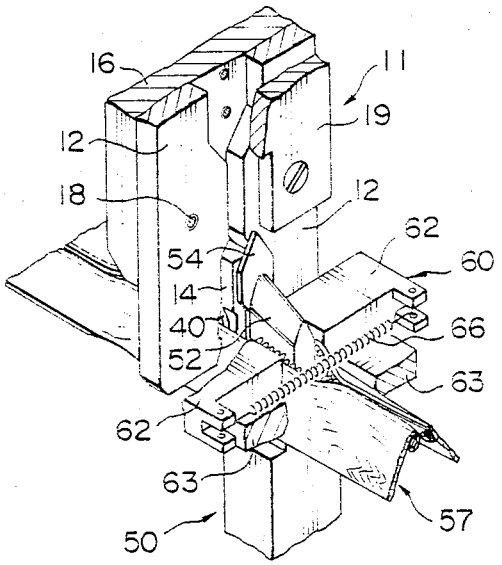
FIG. 14 is an enlarged fragmentary perspective view of the punch mechanism which is lowered toward the separator that has split the intermeshing rows of coupling elements.

The punch/die holder 13 is lowered to the lower position until the U-shaped top end stops 40 supported by the clamping mechanism 11 are fitted over the beaded marginal edges 71 directed upwardly by the separator 50 and the tape holder 60, as shown in FIGS. 6 and 7. At this time, the beaded marginal edges 71 are smoothly guided through the guide slots 47 into the U-shaped top end stops 40 by the slanted surfaces 45, 46, and are not caught by the legs of the top end stops 40 since these legs are snugly received in the recesses 41, 42, as shown in FIG. 4. The downwardly projecting lower end 48 of the die 14 also serves to guide the beaded marginal edges 71 into the top end stops 40 since the lower end 48 first enters the element-free space 73 to direct the stringer tapes 70 respectively along the slanted surfaces 45 of the die 14. Now, the die 14 is positioned directly behind the thin wedge-shaped inserter 54 as illustrated in FIG. 14. The slide fastener chain 55 may longitudinally be backed off to bring the ends of the disengaged coupling element rows into close abutment against the top end stops 40 supported by the clamping mechanism 11, so that the top end stops 40 can accurately be attached to the beaded marginal edges 71 closely to the coupling element rows.

Figure 8:
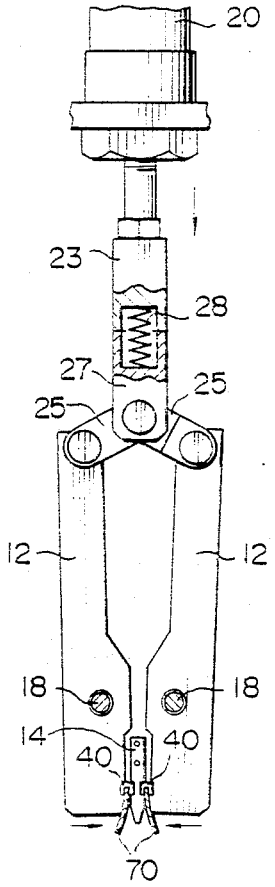
Figure 9:
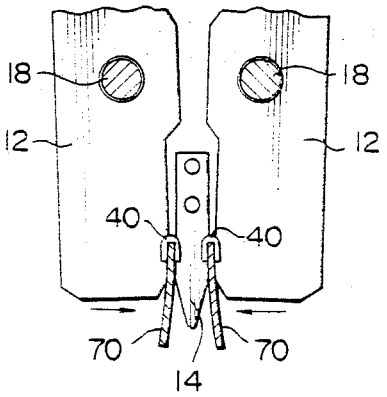
Figure 10:
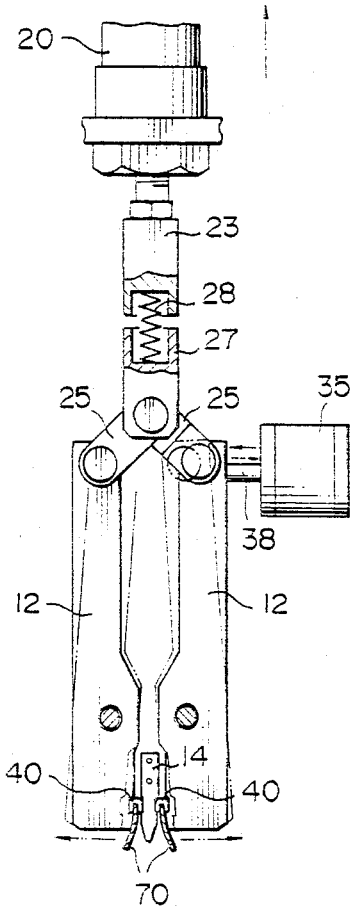

The actuator 20 is then operated to lower the rams 23, 27 to turn the punch arms 12 about the pivot pins 18, moving the lower ends of the punch arms 12 toward the die 14 until the top end stops 40 are clinched about the beaded marginal edges 71, as shown in FIGS. 8 and 9. After the top end stops 40 have been firmly attached to the beaded marginal edges 71, the actuator 20 is operated again to lift the rams 23, 27 to displace the lower ends of the punch arms 12 away from the die 14, thus releasing the attached top end stops 40 from the clamping mechanism 11, as shown in FIG. 10. At the same time, the actuator 35 is operated to extend its piston rod 38 for assisting the punch arms 12 in releasing the top end stops 40 without damaging and deforming them or removing their paint. Thereafter, the punch/die holder 13 is moved upwardly to the upper position in which another pair of top end stops 40 is supplied to the clamping mechanism 12.

The above cycle may automatically be repeated to successively attach pairs of top end stops 40 to the continuous slide fastener chain 55 in the element-free spaces 73 at longitudinally spaced intervals.

Although various minor modifications may be suggested by those varied in the art, it should be understood that we wish to embody within the scope of the patent warranted hereon, all such embodiments as reasonably and properly come within the scope of our contribution to the art.

What is claimed is:

1. An apparatus for attaching a pair of top end stops of a substantially U-shape to a continuous slide fastener chain composed of a pair of stringer tapes supporting a pair of intermeshing rows of coupling elements on and along respective beaded longitudinal marginal edges of the stringer tapes, the slide fastener chain having longitudinally spaced element-free spaces, said apparatus comprising:

(a) a punch/die holder;

(b) a clamping mechanism mounted on said punch/-die holder and including a pair of punch arms pivotably supported on said punch/die holder and a die fixed to said punch/die holder and disposed between first ends of said punch arms supporting the top end stops between said die and said first ends of said punch arms, and (c) means operatively coupled between said punch/-die holder and second opposite ends of said punch arms for pivoting said punch arms to cause said first ends thereof to move toward each other and also toward said die to clinch the top end stops respectively about the beaded marginal edges of the stringer tapes at one of the element-free spaces adjacent to ends of the rows of coupling elements, said means comprising a toggle mechanism composed of a pair of links operatively coupled to said second ends of the punch arms, and a pair of pivot pins by which said punch arms are angularly movably supported on said punch/die holder, said pivot pins being positioned, more closely to said first ends than to said second ends, and an actuator mounted on said punch/die holder for actuating said links, said toggle mechanism further including a first ram coupled to said actuator, a second ram operatively coupled to said links and slidably mounted on said punch/die holder, and a compression coil spring disposed under compression between said first and second rams for normally urging them apart from each other to resiliently bias said first ends of said punch arms with respect to said die.

2. An apparatus for attaching a pair of top end stops of a substantially U-shape to a continuous slide fastener chain composed of a pair of stringer tapes supporting a pair of intermeshing rows of coupling elements on and along respective beaded longitudinal marginal edges of the stringer tapes, the slide fastener chain having longitudinally spaced element-free spaces, said apparatus comprising:

(a) a punch/die holder;

(b) a clamping mechanism mounted on said punch/-die holder and including a pair of punch arms pivotably supported on said punch/die holder and a die fixed to said punch/die holder and disposed between first ends of said punch arms for supporting the top end stops between said die and said first ends of said punch arms, and (c) means operatively coupled between said punch/-die holder and second opposite ends of said punch arms for pivoting said punch arms to cause said first ends thereof to move toward each other and also toward said die to clinch the top end stops respectively about the beaded marginal edges of the stringer tapes at one of the element-free spaces adjacent to ends of the rows of coupling elements, further including an actuator for acting on one of said punch arms for displacing said first ends of the punch arms away from said die.

3. An apparatus for attaching a pair of top end stops of a substantially U-shape to a continuous slide fastener chain composed of a pair of stringer tapes supporting a pair of intermeshing rows of coupling elements on and along respective beaded longitudinal marginal edges of the stringer tapes, the slide fastener chain having longitudinally spaced element-free spaces, said apparatus comprising:

(a) a punch/die holder;

(b) a clamping mechanism mounted on said punch/-die holder and including a pair of punch arms angularly movably supported on said punch/die holder and a die fixed to said punch/die holder and disposed between said punch arms for supporting the top end stops between the die and first ends of said punch arms, said punch arms having a pair of first recesses defined respectively in opposite inner side surfaces thereof, said die having a pair of second recesses defined respectively in opposite outer side surfaces thereof, said first and second recesses jointly defining cavities for holding said top end stops, respectively, therein, with legs of the top end stops being snugly fitted in said first and second recesses and (c) means operatively coupled between said punch/-die holder and second opposite ends of said punch arms for angularly moving said punch arms to cause said first ends thereof to clinch the top end stops respectively about the beaded marginal edges of the stringer tapes at one of the element-free spaces adjacent to ends of the rows of coupling elements.

4. An apparatus according to claim 3, said punch arms having a pair of first slanted surfaces and said die having a pair of second slanted surfaces tapered away from said first slanted surfaces, said first and second slanted surfaces jointly defining a pair of flaring guide slots leading to said cavities, respectively, for smoothly guiding the beaded marginal edges of the stringer tapes into the top end stops, respectively, supported between said punch arms and said die.

5. An apparatus for attaching a pair of top end stops of a substantially U-shape to a continuous slide fastener chain composed of a pair of string tapes supporting a pair of intermeshing rows of coupling elements on and along respective beaded longitudinal marginal edges of the stringer tapes, the slide fastener chain having longitudinally spaced element-free spaces, said apparatus comprising:

(a) a punch/die holder;

(b) a clamping mechanism mounted on said punch/-die holder and including a pair of punch arms pivotably supported on said punch die holder and a die fixed to said punch/die holder and disposed between said first ends of said punch arms for supporting the top end stops between said die and said first ends of said punch arms, (c) means operatively coupled between said punch/-die holder and second opposite ends of said punch arms for pivoting said punch arms to cause said first ends thereof to move toward each other and also toward said die to clinch the top end stops respectively about the beaded marginal edges of the stringer tapes at one of the element-free spaces adjacent to ends of the rows of coupling elements; and (d) directing means for separately directing said beaded marginal edges of the stringer tapes at said one element-free space toward the top end stops supported between said die and first ends of said punch arms, said directing means comprising a separator for progressively disengaging the intermeshing rows of coupling elements from said one element-free space, and a tape holder for coacting with said separator to hold the stringer tapes and the disengaged coupling elements thereon adjacent to said one element-free space for directing said beaded marginal edges thereat toward the top end stops, said separator comprising a separator body including a splitter having a wedge-shaped end, and a wedge-shaped inserter attached to said separator body and projecting beyond said wedge-shaped end, said wedge-shaped end being progressively inclined toward said separator body away from said wedge-shaped inserter, said separator being movable toward said slide fastener chain to cause said wedge-shaped inserter to enter said one element-free space and then to cause said wedge-shaped end to disengage the intermeshing rows of coupling elements progressively from said one element-free space.

6. An apparatus according to claim 5, said separator body having a pair of shoulders disposed one on each side of said splitter for engaging the disengaged rows of coupling elements and moving them into engagement by said tape holder upon movement of said separator.

7. An apparatus according to claim 6, said tape holder comprises a pair of tape holder members having slanted inner surfaces, respectively, for guiding said stringer tapes, and a spring acting between said tape holder members for normally urging them toward each other, said separator being movable between said tape holder members for positioning the stringer tapes and the coupling elements engaged by said shoulders between said tape holder members and said separator.

* * * * *